US006588752B2

(12) United States Patent
Mickowski

(10) Patent No.: US 6,588,752 B2
(45) Date of Patent: Jul. 8, 2003

(54) MULTILEVEL CHECKERS GAME

(76) Inventor: Daria McArdle Mickowski, 50 Walling Rd., Warwick, NY (US) 10990

( * ) Notice: Subject to any disclaimer, the term of this patent is extended or adjusted under 35 U.S.C. 154(b) by 0 days.

(21) Appl. No.: 09/929,232

(22) Filed: Aug. 13, 2001

(65) Prior Publication Data

US 2003/0030215 A1 Feb. 13, 2003

(51) Int. Cl.[7] ..... A63F 3/02

(52) U.S. Cl. ..... 273/241; 273/243; 273/262; 273/253; 273/131; 273/272; 273/260

(58) Field of Search ..... 273/260, 236, 273/243, 262, 253, 272, 241

(56) References Cited

U.S. PATENT DOCUMENTS

| | | | | | |
|---|---|---|---|---|---|
| 689,137 | A | * | 12/1901 | Snyder | 273/260 |
| 1,204,246 | A | * | 11/1916 | Carter | 273/260 |
| 1,228,542 | A | * | 6/1917 | Durbin | 273/260 |
| 2,610,060 | A | * | 9/1952 | Powell | 273/260 |
| D210,542 | S | | 3/1968 | Stookey | |
| 3,399,895 | A | * | 9/1968 | Beach | 273/241 |
| 3,408,073 | A | * | 10/1968 | Suvada | 273/260 |
| 3,434,719 | A | * | 3/1969 | Fyanes | 273/260 |
| D215,103 | S | | 9/1969 | Stevens | |
| 3,531,123 | A | * | 9/1970 | Peebles | 273/260 |
| 3,588,114 | A | * | 6/1971 | Vogel | 273/260 |
| 3,608,904 | A | * | 9/1971 | Margetson | 273/260 |
| D231,846 | S | * | 6/1974 | Tchou | D34/5 SS |
| 3,871,657 | A | * | 3/1975 | Lorenz et al. | 273/239 |
| 3,897,953 | A | * | 8/1975 | Hovnanian | 273/258 |
| D236,993 | S | * | 9/1975 | Davis | D34/5 SS |
| 3,929,337 | A | * | 12/1975 | Hayes | 273/146 |
| 3,994,498 | A | | 11/1976 | Breslow | |
| 3,997,165 | A | | 12/1976 | Barsky | |
| 3,999,760 | A | * | 12/1976 | Wilson | 273/153 J |
| 4,036,501 | A | * | 7/1977 | Hovnanian | 273/258 |
| 4,083,564 | A | * | 4/1978 | Matsumoto | 273/239 |
| 4,099,723 | A | | 7/1978 | Robinson | |
| 4,194,741 | A | * | 3/1980 | Rea | 273/241 |
| 4,411,433 | A | * | 10/1983 | Flynn | 273/260 |
| 4,938,482 | A | * | 7/1990 | Ludwick et al. | 273/260 |
| 5,116,062 | A | * | 5/1992 | Johnson | 273/260 |
| 5,272,028 | A | * | 12/1993 | Kashizaki et al. | 358/401 |
| 5,358,252 | A | | 10/1994 | McPhaul | |
| 5,456,472 | A | * | 10/1995 | Goodman | 273/241 |
| 5,511,793 | A | * | 4/1996 | Watt | 273/260 |
| 5,636,841 | A | | 6/1997 | Burroughs | |
| 5,690,332 | A | * | 11/1997 | Rechs | 273/260 |
| 5,735,523 | A | * | 4/1998 | Fioriglio | 273/260 |
| 5,839,727 | A | * | 11/1998 | Stillinger | 273/260 |
| 5,908,193 | A | * | 6/1999 | Houman | 273/261 |
| 6,095,523 | A | * | 8/2000 | Lampman | 273/260 |
| 6,182,967 | B1 | | 2/2001 | Green | |
| 6,189,887 | B1 | | 2/2001 | Dommasch | |
| 6,196,543 | B1 | | 3/2001 | Cornett | |
| 6,196,920 | B1 | | 3/2001 | Spaur | |
| 6,203,016 | B1 | | 3/2001 | Frommer | |
| 6,257,575 | B1 | * | 7/2001 | Ortega | 273/241 |
| 6,345,822 | B1 | * | 2/2002 | Reynolds | 273/281 |
| 6,412,776 | B1 | * | 7/2002 | Baxter et al. | 273/242 |

FOREIGN PATENT DOCUMENTS

| | | | |
|---|---|---|---|
| FR | 2604368 | * | 9/1986 |

* cited by examiner

*Primary Examiner*—Benjamin H. Layno
*Assistant Examiner*—Dolores Collins
(74) *Attorney, Agent, or Firm*—Reed Smith LLP

(57) ABSTRACT

The invention is a board game and method of playing checkers on this specific board game comprising: a planar 10 row by 10 column checker board comprising 100 square spaces to place game pieces upon; a plurality of said 100 square spaces further including vertical riser blocks affixed to the checker board to provide projecting spaces projecting above the plane of the checker board.

12 Claims, 5 Drawing Sheets

MULTILEVEL CHECKERS GAME

FIELD OF INVENTION

The present invention relates to the field of gaming including board games and computerized play of board games including play via networks including the world wide web.

BACKGROUND OF THE INVENTION

The first references to the game of checkers are found as early as 1600 B.C. in Egyptian paintings and inscriptions at the time of the Pharaohs. In England and Scotland, this game is called 'draughts' (pronounced as 'drafts'). There are many versions played worldwide.

Checkers on an 8×8 board, is the checkers game played mostly in Great Britain (where it is called draughts), USA, Canada, Australia, Ireland, and a few other countries. The most popular version of checkers, however is played on a 10×10 board in Eastern Europe. In the USA, that game is sometimes called Polish Checkers. Elsewhere, it is called International Draughts. There are other 8×8 varieties played in Spain and Italy and elsewhere.

Anglo-American Checkers or draughts is a game for two players. It is played on an 8×8 checkered board, with a dark square in each player's lower left corner (see FIG. 1 wherein the "dark" squares are dotted and numbered).

Pieces move only on dark squares (numbered in FIG. 1). Numbers are used to record the moves, for example, if Red moves from square 9 to square 13, then it is recorded as: 9–13.

Each player controls its own army of pieces (men). The player who controls Red pieces moves first. The pieces (also known as 'men') are arranged as shown in FIG. 1.

The goal in the checkers game is either to capture all of the opponent's pieces or to blockade them. If neither player can accomplish the above, the game is a draw.

Starting with Red, the players take turns moving one of their own pieces. A "piece" means either a "man" an ordinary single checker or a "king" which is what a man becomes if it reaches the last rank.

A man may move one square diagonally only forward, that is, toward the opponent onto an empty square. Thus, for example in FIG. 1, the red pieces can move 12–16, 11–16 or 11–15. Similarly, the white pieces can move 24–20, 24–19 or 23–19.

Checkers rules state the captures or "jumps" are mandatory. If a square diagonally in front of a man is occupied by an opponent's piece, and if the square beyond that piece in the same direction is empty, the man may "jump" over the opponent's piece and land on the empty square. The opponent's piece is captured and removed from the board. Thus, in FIG. 1 red can "jump" 14–21, leaving square (where white man used to stand) 17 empty. Similarly, if it were white turn to move, the white man could "jump" over its red counterpart 17–10, leaving square 14 empty. If in the course of single or multiple jumps the man reaches the last rank, becoming a king, the turn shifts to the opponent. No further 'continuation' jump is possible.

When a single piece reaches the last rank of the board by reason of a move, or as the completion of a "jump", it becomes a king; and that completes the move, or "jump".

A king can move in any direction and "jump" in any direction one or more pieces, as the limits of the board permit. The king can only jump diagonally over one adjacent piece at a time, in any of the four diagonal directions. Multiple jumps are possible.

There are two main styles of checkers played in tournaments, Go-As-You-Please (sometimes called Freestyle or Unrestricted) and 3-Move Restriction. In Go-As-You-Please, you can make any opening moves that you want. In 3-Move, the first 3 moves (Red-White-Red) are chosen at random from a list of accepted 3-Move openings. The list contains no openings that are known losses. 3-Move is more popular in serious tournaments and matches, as it decreases the number of draws. After playing a game with one of the 3-Move openings, you play a second game with the same opening, but from the other side of the board, to even out the disadvantage of having to play a weak opening (such as the Octopus or the Skull Cracker).

There are World Championship Matches in both styles. The 3-move World Championship is the more prestigious. There are National Championship Tournaments, District Tournaments, State Tournaments, local tournaments, mail tournaments, mail ladders, International Team Matches (both over-the-board and mail), and other events.

The U.S. National Tournament is currently the strongest and most prestigious tournament in the world. Every 4th year, the winner of that tournament is the official challenger for the World Championship. Midway between these years, the British Championship Tournament determines the official challenger for the World Championship.

There are also other forms of checkers as listed below.

Italian Checkers (Dama):The board is rotated 90 degrees, so a double corner is to the left of each player. A king cannot be captured by an ordinary piece; kings can only be captured by kings. If you have a choice of jumps, you must capture the greatest number of pieces, or (if the number of captured pieces is equal) you must capture a king rather than an ordinary piece.

Spanish Checkers (Dama):The board is rotated 90 degrees, so a double corner is to the left of each player. A king cannot be captured by an ordinary piece; kings can only be captured by kings. If you have a choice of jumps, you must capture the greatest number of pieces, or (if the number of captured pieces is equal) you must capture a king rather than an ordinary piece. A king can move any distance along a diagonal, if not blocked. A king can make long jumps over a piece, any distance beyond the captured piece, if the way is clear of pieces.

International Checkers or Draughts (Polish Checkers): Played on a 10×10 board, oriented as in our English version. Each player has 20 pieces, which begin in the first four rows. Ordinary pieces move only forward, but may capture backward (in short leaps as in the English version). A king can make long jumps (or a series of such jumps) when capturing. A king can make long jumps over a piece (or a series of such jumps over pieces), any distance in front of, or beyond the captured piece, if the way is clear of pieces. An ordinary piece which jumps onto the back row, must continue jumping off the back row, if possible; and it does not become a king until it lands on the back row at the end of a move (or jump).

Canadian Checkers (Grand jeu de dames): Exactly like International Checkers, but on a 12×12 board.

Damenspiel/German Checkers/Spanish Pool Checkers: Exactly like International Checkers, but on an 8×8 board. A promoted piece is called a queen (dame).

Russian Checkers (Shashki): Like Damenspiel, except that capturing is not forced. And a piece becomes a queen when it touches the king row, even if it continues to jump off the king row on that move.

Giveaway Checkers (Losing Game): Like our English version, except the object is to give away all of your pieces.

SUMMARY OF THE INVENTION

The invention is a "chuckers" board game and a new method of playing checkers on this specific board game comprising: a planar 10 row by 10 column checker board comprising 100 square spaces to place game pieces upon; a plurality of said 100 square spaces further including vertical riser blocks affixed to the checker board to provide projecting spaces projecting above the plane of the checker board.

Play is as in Anglo-American Checkers, but there are few different rules. Players may jump their own piece, but not in combination with jumping the opponents piece. However, the player (who can jump their own piece as well as their opponents if allowed) may wait until their next turn to jump their opponents piece which can be referred to as a "delayed double jump move." The "double jump move" is frequently referred to Anglo-checkers when a player may jump a piece moving or jumping more than one place at a time.

A game piece on a raised block may be jumped, but the piece is not taken by the opponent. To be kinged, a game piece must make it to the other side of the board, and then flip over the piece to show patterned side respectively. A king may move in any direction, and can jump and take away any game piece, including ones on raised blocks. A player may also jump pieces on raised blocks (even if they are their own). A player may only take away an opponent's piece located on the raised blocks, if they are kinged. The winner is the player with pieces remaining on the game board.

The invention is at least an improvement over traditional checkers games because play is quickened and more complex strategies emerge than are already known in the art.

DETAILED DESCRIPTION OF THE INVENTION

Figure 1:
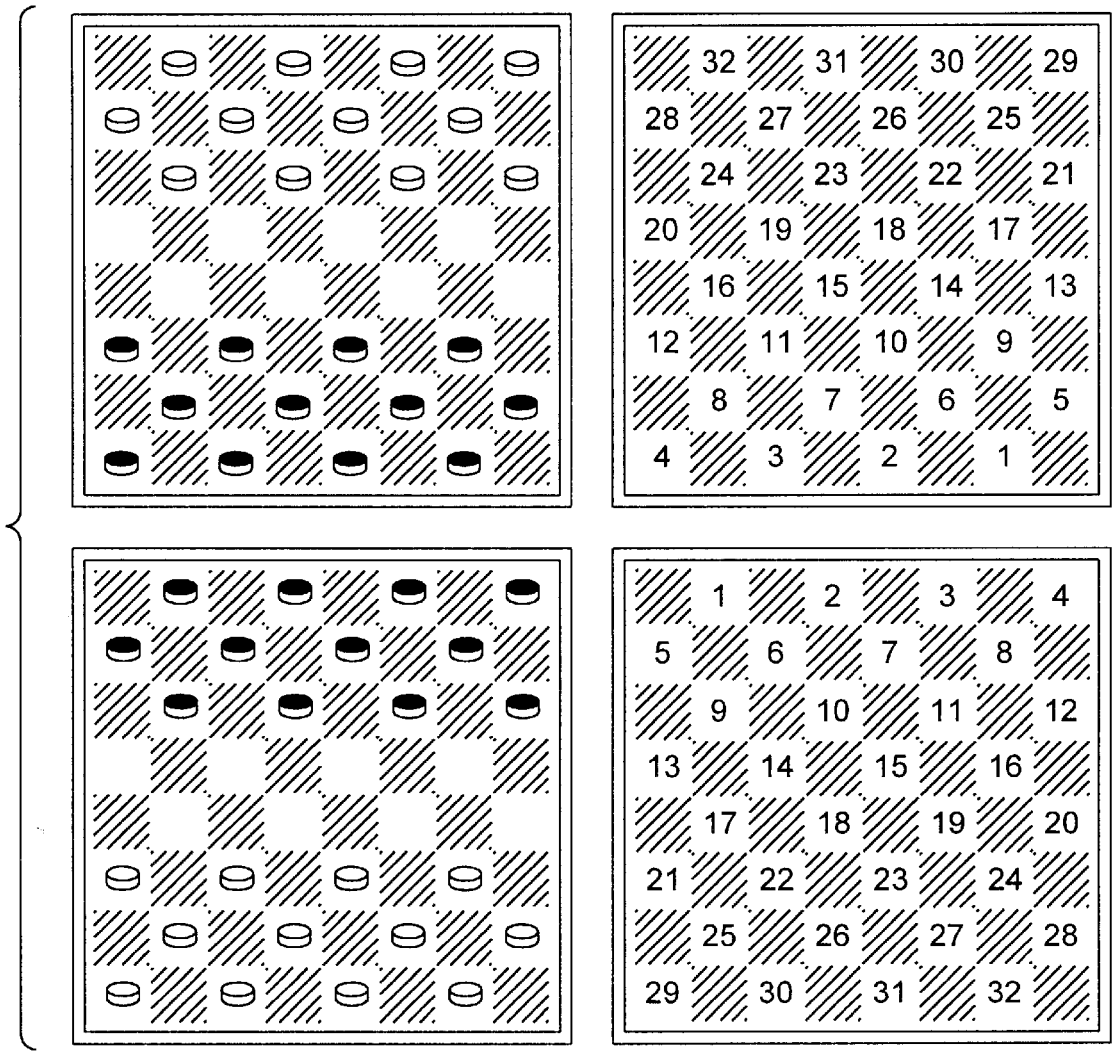
F I G. 1 PRIOR ART
FIG. 1 is a top view of a prior art standard 8×8 checker board.
Figure 2:
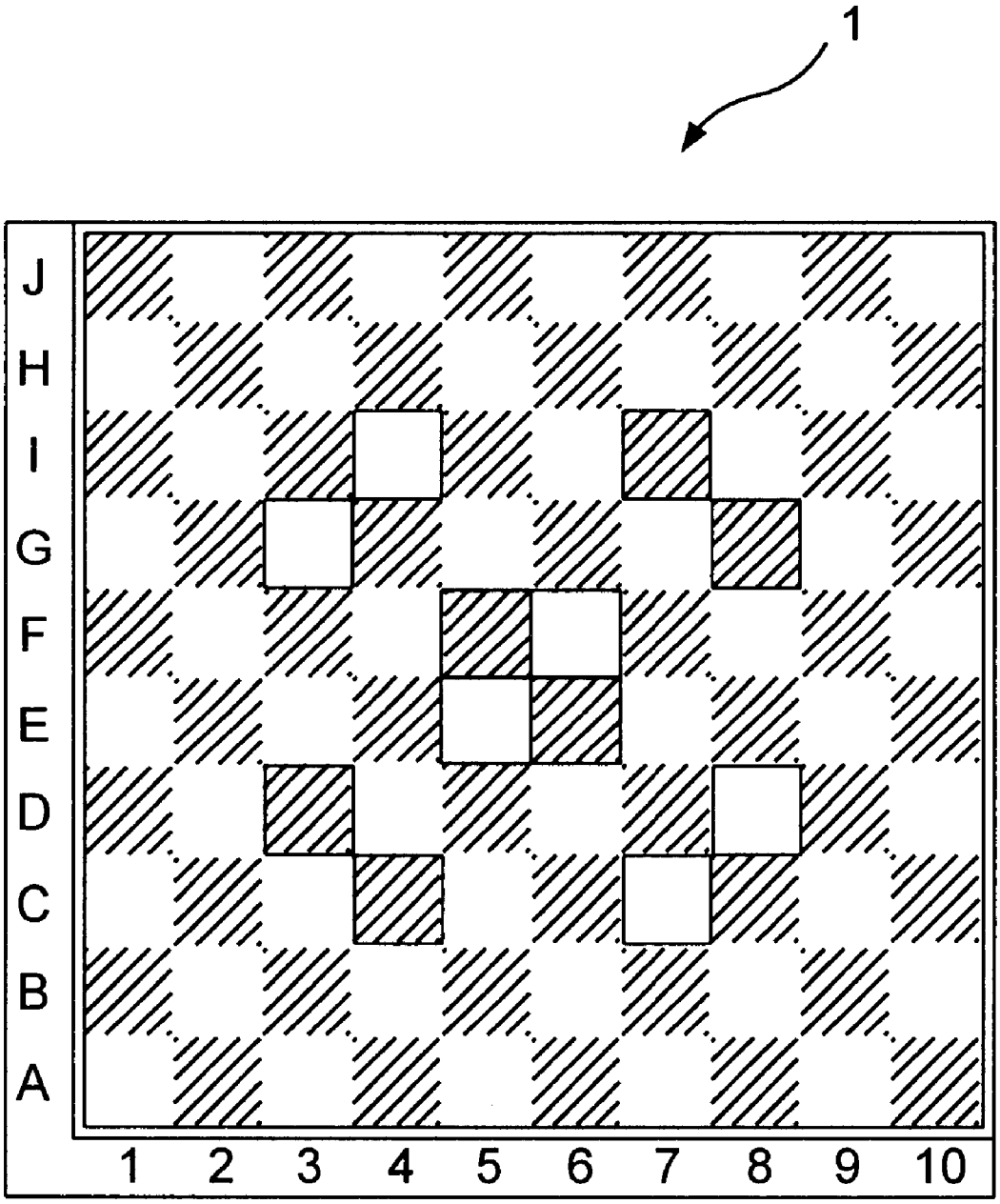
FIG. 2 is a top view of the 10×10 checker board according to the present invention
Figure 3:
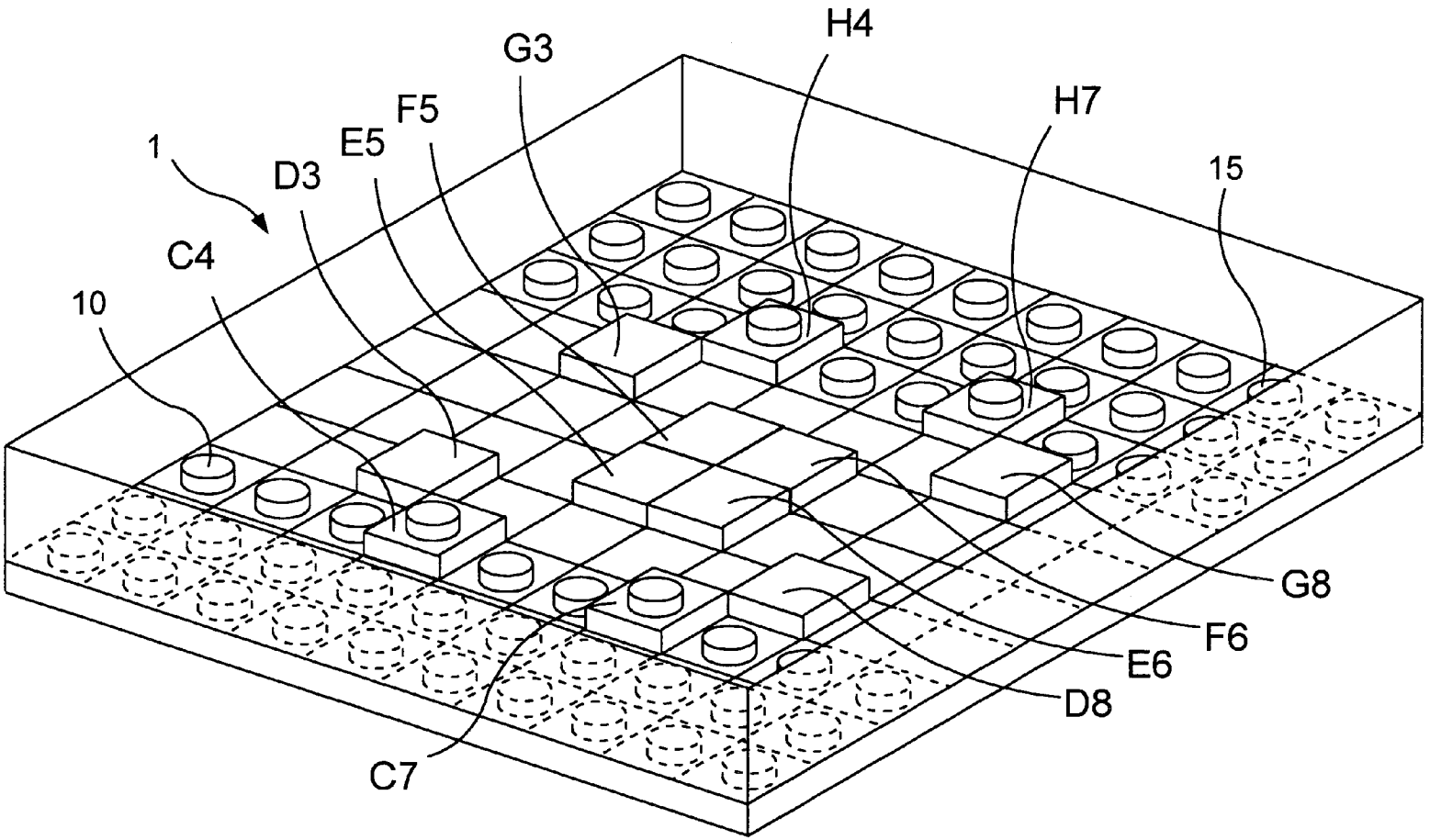
FIG. 3 is a perspective view of the 10×10 checker board according to the present invention.
Figure 4:
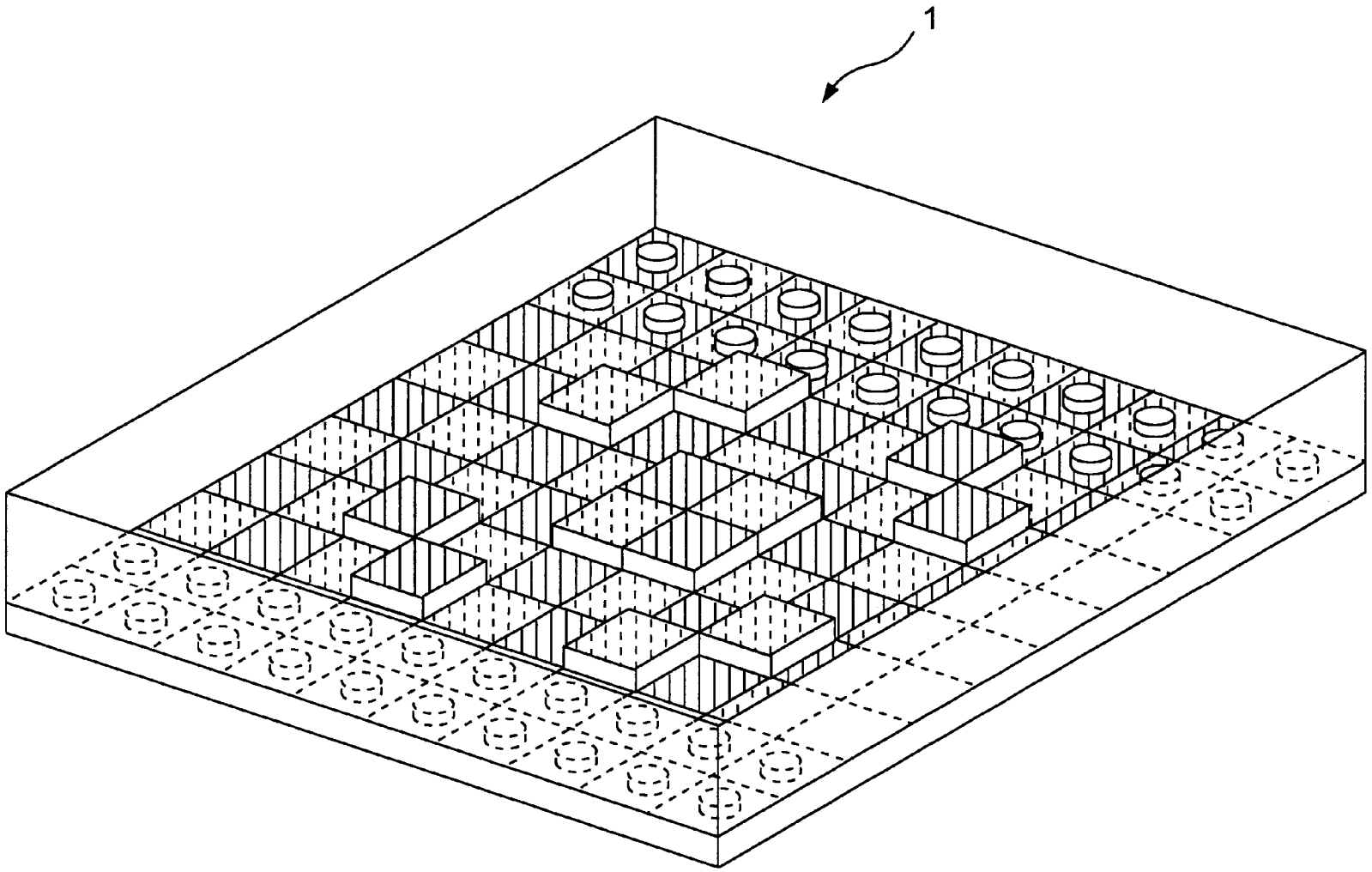
FIG. 4 is a perspective view of the 10×10 game board according to a preferred embodiment of the present invention wherein purple and red color shading are indicated.
Figure 5A:
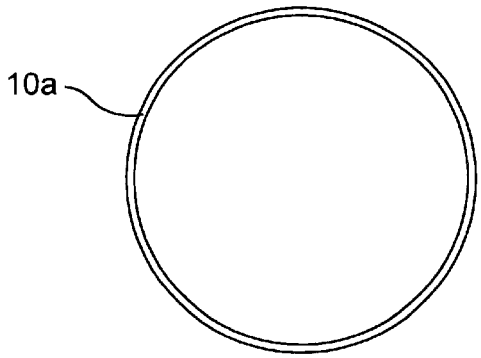
FIG. 5*a* is a top view of the solid colored side of the preferred embodiment of a red game piece.
Figure 5:
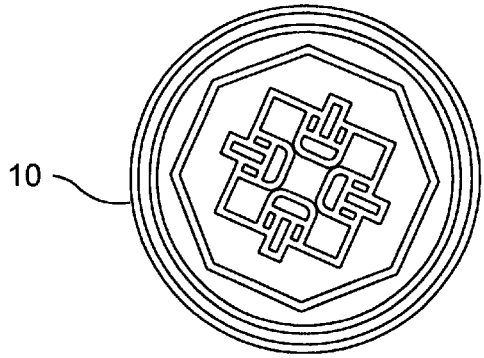
FIG. 5 is a top view of the patterned side of the preferred embodiment of a red game piece.
Figure 6:
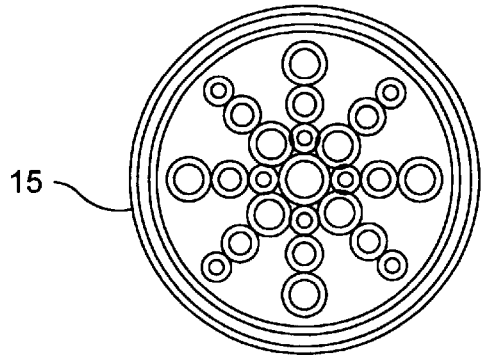
FIG. 6 is a top view of the patterned side of the preferred embodiment of a purple game piece.
Figure 6A:
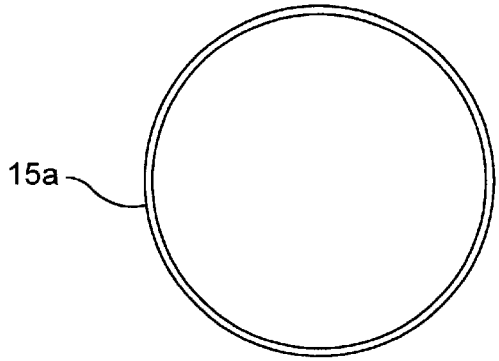
FIG. 6*a* is a top view of the solid colored side of the preferred embodiment of a purple game piece.

As shown in FIGS. 2 and 3, the preferred embodiment of the present invention is played on a 10×10 Board, similar to the Polish Checkers board. However, the checker board 1, also termed a "chuckers" board, according to the present invention, further includes vertical riser blocks (which shall be referred to by location name, E5, etc.) affixed to the checker board 1 to provide projecting spaces vertically or squares projecting above the plane of the checker board at locations E5, E6, F5, F6, C4, C7, D3, D8, G3, G8, H4 and H7 to place game pieces upon.

Play occurs according to Anglo-American checkers rules, except for the differences discussed below. The dark squares are used by games pieces as well as the light squares. Red game pieces in the preferred embodiment shown in FIG. 3 are designated by Ref. Num. 10. Purple game pieces in the preferred embodiment shown in FIG. 3 are designated by Ref. Num. 15.

Preferred Embodiment and Best Mode Rules and Play.

Place pieces (10, 15) colored side up (10*a*, 15*a*) on the checker board 1. There are enough pieces to cover three rows, i.e., 30 pieces. Place the pieces (10, 15) on the raised blocks (See locations C4, C7, H4 and H7) in the $3^{rd}$ rows. In the preferred embodiment therefore, there are 60 pieces, 30 for each player's side. However, any number of pieces may be used according to the player's preferences.

Play as in Anglo-American Checkers, but there are few different rules.

Players may jump their own piece, but not in combination with jumping the opponent's piece.

To be kinged, a game piece must make it to the other side of the board, and then flip over the piece to show patterned side 10 or 15 respectively.

A game piece on a raised block may be jumped, but the piece is NOT taken by the opponent. However, a kinged game piece or king may jump and take away his opponent's piece, even if the opponent's piece is on a raised block.

In short, king may move in any direction, and can jump and take away any game piece, including ones on raised blocks.

The winner is the person with pieces remaining on the game board.

Variation A

The first alternative embodiment is the same as method above wherein the step of jumping your own piece, but not in combination with jumping your opponent; is eliminated and in favor of the step of: permitting a player to jump said player's own game piece in combination with jumping an opponent's game piece. Additionally, the step is included wherein when capturing a king, the player capturing the king is allowed to put one of his pieces back on the board, but it may not be a king until is it kinged again as in normal play.

Variation B

Another alternative embodiment is the same as the preferred embodiment method above, wherein the step of jumping your own piece, but not in combination with jumping your opponent is eliminated in favor of the step of: permitting a player to jump only the opponent's game pieces and prohibiting said player from jumping said player's own game pieces. Also, the step is included wherein the step of jumping game pieces wherein a game piece on a raised block may be jumped but the piece is not taken by the opponent is eliminated in favor of the step of: jumping wherein only kinged game pieces cannot be taken while jumping pieces on the raised blocks.

Those skilled in the art will appreciate that many changes could be made to the embodiments described herein without departing from the spirit and scope of the invention. For example, this invention may be played over the world wide web using electronic graphics to represent the game board.

What is claimed is:

1. A board game comprising:

a plurality of game pieces;

a planar ten row by ten column checker board having one-hundred square spaces for placing said game pieces thereon;

said one-hundred square spaces including vertical riser blocks affixed to said checker board providing projecting spaces which project above said checker board;

wherein the game is played with the following variation from an Anglo-American checkers game:

a game piece on the vertical riser block may be jumped but said game piece is not taken unless said game piece performing said jumping is kinged; and said kinged game piece may move in any direction, and can jump to take away any piece, including ones on the vertical riser blocks.

2. The board game of claim 1 wherein:

twelve vertical riser blocks are provided.

3. The board game of claim 2 wherein:

said twelve vertical riser blocks are located at positions as follows on said checker board corresponding to ten columns designated 1–10 and ten rows designated A–J wherein space A1 is a dark square;

four center vertical riser blocks located at the four center spaces of said checker board corresponding to positions E5, E6, F5, and F6;

a fifth vertical riser located on the space located at position C4;

a sixth vertical riser located on the space located at position C7;

a seventh vertical riser located on the space located at position D3;

an eighth vertical riser located on the space located at position D8;

a ninth vertical riser located on the space located at position G3;

a tenth vertical riser located on the space located at position G8;

an eleventh vertical riser located on the space located at the position H4; and a twelfth vertical riser located on the space located at position H7.

4. A method of playing checkers comprising the steps of:

providing a planar ten row by ten column checker board having one-hundred square spaces for placing game pieces thereon and having vertical riser blocks affixed to the checker board to provide projecting spaces projecting above said checker board;

providing each player with an equal number of colored two sided game pieces with one designated color for each player wherein each game piece has a first pattern on one side and a second pattern on the other side;

placing said game pieces with the side having the first pattern up on the checker board in rows on each opposing side of the checker board at the start of play;

playing as in Anglo-American checkers but with the following different steps:

kinging a game piece wherein to be kinged said game piece must reach the opposing side of said checker board, and then said game piece is flipped over to expose the second pattern;

jumping said game pieces wherein a game piece on the vertical riser block may be jumped but said game piece is not taken unless said game piece performing said jumping is kinged;

moving a kinged game piece wherein said kinged game piece may move in any direction, and can jump and take away any piece, including ones on the vertical riser blocks; and ending the game wherein a winner is the player with pieces remaining on the game board.

5. The method of claim 4 wherein the different steps include:

permitting a player to jump a player's own game piece; and permitting a player to jump a player's own game piece in combination with jumping an opponent's game piece.

6. The method of claim 5 further comprising the step wherein when capturing a king, a player capturing the king is allowed to put one of said player's game pieces back on the board but said game piece may not be a king until said game piece kinged again as in Anglo American play.

7. The method of claim 4 wherein the different steps include:

permitting a player to jump only an opponent's game pieces and prohibiting said player from jumping said player's own game pieces.

8. The method of claim 7 wherein the step of jumping game pieces wherein a game piece on a raised block may be jumped but said game piece is not taken by the opponent is eliminated in favor of the step of:

jumping wherein only kinged game pieces cannot be taken while jumping pieces on the raised blocks.

9. A method of playing checkers comprising the steps of:

providing a planar ten row by ten column checker board having one-hundred square spaces for placing game pieces thereon and having vertical riser blocks affixed to the checker board to provide projecting spaces projecting above said checker board;

providing each player with an equal number of colored two sided game pieces with one designated color for each player wherein each game piece has one solid colored side and one patterned side;

placing said game pieces with the solid colored side up on the checker board in rows on each opposing side of the checker board at the start of play;

playing as in Anglo-American checkers but with the following different steps:

jumping a player's own game piece and jumping a player's own game piece in combination with jumping an opponent's game piece are both allowed;

kinging a game piece wherein to be kinged said game piece must reach the opposing side of said checker board, and then said game piece is flipped over to expose the patterned side;

jumping said game pieces wherein a game piece on the vertical riser block may be jumped but said game piece is not taken unless said game piece performing said jumping is kinged;

moving a kinged game piece wherein said kinged game piece may move in any direction, and can jump and take away any piece, including ones on the vertical riser blocks;

when capturing a king, a player capturing the king is allowed to put one of said player's game pieces back on the board but said game piece may not be a king until said game piece is kinged again as in Anglo American play; and ending the game wherein a winner is the player with pieces remaining on the game board.

10. The method according to claim 4, wherein jumping a player's own game piece is allowed, but not in combination with jumping an opponent's game piece.

11. The method according to claim 4, wherein jumping a player's own game piece and jumping a player's own game piece in combination with jumping an opponent's game piece are both allowed.

12. A method of playing checkers comprising the steps of:

providing a planar N row by M column checker board having a plurality of square spaces for placing game pieces thereon and vertical riser blocks affixed to associated ones of the square spaces to provide projecting spaces projecting above the checker board;

providing each player with an equal number of colored two sided game pieces with one designated color for each player wherein each game piece has a first pattern on one side and a second pattern on the other side;

placing the game pieces with the side having the first pattern up on the checker board in rows on each opposing side of the checker board at the start of play;

playing as in Anglo-American checkers but with the following different steps:

kinging a game piece wherein to be kinged the game piece must reach the opposing side of the checker board, and then the game piece is flipped over to expose the second pattern;

jumping the game pieces wherein a game piece on the vertical riser block may be jumped but the game piece is not taken unless the game piece performing the jumping is kinged; and moving a kinged game piece wherein the kinged game piece may move in any direction, and can jump and take away any game piece, including ones on the vertical riser blocks.

* * * * *